US008704861B2

(12) United States Patent
Amino

(10) Patent No.: US 8,704,861 B2
(45) Date of Patent: Apr. 22, 2014

(54) DISPLAY APPARATUS AND METHOD OF DRIVING THE SAME

(71) Applicant: Samsung Display Co., Ltd., Yongin (KR)

(72) Inventor: Tadashi Amino, Tokyo (JP)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 13/756,277

(22) Filed: Jan. 31, 2013

(65) Prior Publication Data

US 2013/0141478 A1 Jun. 6, 2013

Related U.S. Application Data

(62) Division of application No. 12/641,279, filed on Dec. 17, 2009, now Pat. No. 8,368,726.

(30) Foreign Application Priority Data

Mar. 25, 2009 (KR) ..... 10-2009-0025333

(51) Int. Cl.
*G09G 5/10* (2006.01)
*G09G 3/36* (2006.01)

(52) U.S. Cl.
USPC ..... 345/690; 345/102

(58) Field of Classification Search
None
See application file for complete search history.

(56) References Cited

U.S. PATENT DOCUMENTS

2002/0003522 A1 1/2002 Baba et al.
2006/0267904 A1 11/2006 Aiba
2008/0068359 A1 3/2008 Yoshida et al.
2008/0074372 A1 3/2008 Baba et al.
2008/0284719 A1 11/2008 Yoshida
2009/0002586 A1 1/2009 Kimura
2009/0146990 A1* 6/2009 Lin et al. ..... 345/214
2009/0309903 A1 12/2009 Park et al.

FOREIGN PATENT DOCUMENTS

| | | |
|---|---|---|
| CN | 1637824 | 7/2005 |
| CN | 101086573 | 12/2007 |
| JP | 2007-133051 | 5/2007 |
| JP | 2007-233102 | 9/2007 |
| JP | 2008-70838 | 3/2008 |
| JP | 2008-076644 | 4/2008 |
| JP | 2008-287118 | 11/2008 |
| JP | 2010-085946 | 4/2010 |
| JP | 2010-164953 | 7/2010 |
| KR | 10-2005-0086357 | 8/2005 |
| KR | 10-2008-0000632 | 1/2008 |
| KR | 10-2008-0000800 | 1/2008 |

* cited by examiner

*Primary Examiner* — Christopher R Lamb
(74) *Attorney, Agent, or Firm* — Innovation Counsel LLP

(57) ABSTRACT

Disclosed are a display apparatus and a method of driving the same. An image signal receiver sequentially outputs frames for image display. A local illumination calculation unit displays an image on a display unit based on the frames and calculates light emission amount of a light source provided for each section of a backlight unit. A frame interpolator generates sub-frames based on the frames and outputs the sub-frames and the frames. A pixel adjuster adjusts light transmittance of each pixel according to the brightness of each pixel and the amount of the light emitted from each section which is calculated by the local illumination calculation unit when the image is displayed based on the frames and the sub-frames sequentially output from a frame interpolator. Local illumination is realized without increasing the number of memory devices while a frame frequency is increased.

4 Claims, 10 Drawing Sheets

Fig. 6

| | | |
|---|---|---|
| $d^n_{11}$ | $d^n_{12}$ | $d^n_{13}$ |
| $d^n_{21}$ | $d^n_{22}$ | $d^n_{23}$ |
| $d^n_{31}$ | $d^n_{32}$ | $d^n_{33}$ |

Fig. 7

$$ {}_{s}D^{n}_{12} = \sum_{k,l} \alpha^{kl}_{1j} \; d^{n}_{kl} $$

| | | |
|---|---|---|
| ${}_{s}D^{n}_{11}$ | ${}_{s}D^{n}_{12}$ | ${}_{s}D^{n}_{13}$ |
| ${}_{s}D^{n}_{21}$ | ${}_{s}D^{n}_{22}$ | ${}_{s}D^{n}_{23}$ |
| ${}_{s}D^{n}_{31}$ | ${}_{s}D^{n}_{32}$ | ${}_{s}D^{n}_{33}$ |

Fig. 8

$$D^n_{12} = \beta\ {}_sD^n_{11} + (1-\beta)D^n_{11}$$

| | | |
|---|---|---|
| $D^n_{11}$ | $D^n_{12}$ | $D^n_{13}$ |
| $D^n_{21}$ | $D^n_{22}$ | $D^n_{23}$ |
| $D^n_{31}$ | $D^n_{32}$ | $D^n_{33}$ |

DISPLAY APPARATUS AND METHOD OF DRIVING THE SAME

CROSS-REFERENCE TO RELATED APPLICATION

This application is a divisional of U.S. patent application Ser. No. 12/641,279, filed on Dec. 17, 2009, which relies for priority upon Korean Patent Application No. 10-2009-0025333 filed on Mar. 25, 2009, the contents of which are herein incorporated by reference in their entirety.

BACKGROUND

1. Field of the Invention

The present invention relates to a display apparatus and a driving method of the same. More particularly, the present invention relates to a display apparatus capable of reducing a number of parts and power consumption and a method of driving the display apparatus.

2. Description of the Related Art

As a display apparatus that displays images, a display apparatus employing a liquid crystal panel is extensively used. The display apparatus employing the liquid crystal panel, in general, is driven by a hold-type driving mode of which a light transmitting amount is maintained until a display period of a next frame. Accordingly, when moving images are displayed, after-images occur or moving images became unfocused. In general, a frame interpolation method, which increases the number of frames and a frame frequency, is widely used to remove the after-images. However, in order to increase the frame frequency, information of a few frames is required to be maintained.

In addition, in case that light is leaked from the liquid crystal panel, it is difficult to improve a contrast ratio of a display image. To this end, a local illumination scheme is performed by dividing a backlight into a plurality of areas, controlling an amount of light emitted in each area, and providing the light to areas in which image is displayed. According to the local illumination scheme, power consumption is reduced.

However, the information corresponding to one frame is required to be maintained in order to delay an operation time for the local illumination. To this end, when a scheme increasing the frame frequency is combined with the local illumination scheme, the amount of information that is required to be maintained increases, and thus the amount of memory required also increases.

As a result, various disadvantages are caused, such as an increase of circuit size, increase of manufacturing cost, and increase of power consumption. In addition, the display of frame is delayed due to the increase of the frame frequency and the local illumination. Thus, when sounds are output in synchronization with the frame, additional memory is required.

SUMMARY

Therefore, an embodiment of the present invention provides a display apparatus capable of increasing a frame frequency and performing local illumination without increasing the number of memory devices or delay time.

Another embodiment of the present invention also provides a method of driving the display apparatus.

In one aspect of the present invention, a display apparatus includes a backlight unit, an image signal receiver, a local illumination calculation unit, a backlight controller, a frame interpolator, and a pixel adjuster.

The backlight unit has a plurality of sections on which light sources are installed, and the display unit has a plurality of pixels, which allow light generated from the light sources to pass therethrough. The image signal receiver receives an image signal of a plurality of consecutive frames to sequentially output the frames. The local illumination calculation unit calculates light amount of the sections of the backlight unit based on brightness of the frames sequentially output from the image signal receiver. The backlight controller controls the light sources based on the light amount calculated by the local illumination calculation unit and the frame interpolator generates sub-frames based on the frames sequentially output from the image signal receiver and sequentially outputs the frames and the sub-frames. The pixel adjuster adjusts light transmittance of each pixel according to pixel brightness of the frames and the sub-frames, which are sequentially output from the frame interpolator, and the light amount calculated by the local illumination calculation unit.

The pixel adjuster adjusts light transmittance of a pixel corresponding to reduction of the light amount, which is calculated by the local illumination calculation unit with respect to each section of the backlight unit, from a maximum amount of light that can be generated from each section. For example, the pixel adjuster divides the light transmittance of a pixel by 0.8 when the amount of light generated from a section of the backlight unit is reduced to 20%.

The display apparatus controls light amount of each light source of the backlight unit based on the brightness of an input frame image, and increases a frame frequency by generating the sub-frames. The display apparatus corrects the brightness of each pixel based on the light amount of each light source. Accordingly, the adjustment of the brightness of each pixel through the delay of the frame and the sub-frame is unnecessary. In addition, delay time from the acquisition of the image signal to the display of the image signal is not increased. Memory devices are not additionally required because the delay time is not increased. The power consumption of the display apparatus can be reduced due to the local illumination.

The local illumination calculation unit calculates the amount of the light, which is generated from the sections of the backlight unit, within a period at which the image signal receiver outputs a frame. The local illumination calculation unit may calculate the amount of the light at a same period as the image receiver outputs a frame as well. For example, when the image signal receiver outputs frames with an interval of 1/60 second, the local illumination calculation unit calculates light amount in the sections of the backlight unit.

Therefore, even if the display frame frequency is increased by generating the sub-frames, the increase of the operating speed of the local illumination calculation unit is not required. Accordingly, the power consumption is not increased.

In addition, the frame interpolator may output the sub-frames after outputting the frames transmitted from the image signal receiver. For example, the sub-frames may be interpolated between the frames output from the image signal receiver.

Accordingly, since each frame may have correlation with each sub-frame transmitted next to the frame, image incongruity can be prevented even if each pixel of the sub-frame is corrected using light generated based on the brightness of a frame image.

In order to interpolate the sub-frame, a difference value is calculated between two or more frames prior to the sub-frame, and applied to the last frame among the frames prior to the sub-frame, thereby generating the sub-frame.

The difference value may be a motion vector between two or more frames. In this case, the positions of pixels of the latter frame between the two frames prior to the sub-frame are moved along the motion vector so that the sub-frame may be generated.

If the motion vector cannot be calculated, the last frame among proceeding two or more frames may be employed as the sub-frame. Accordingly, even if an image has great time variation, image incongruity can be prevented.

The frame interpolator may have two frame memories, each of which can sufficiently store one frame, and the local illumination calculation unit may read out the frame from the two frame memories. Therefore, memory capacity is not additionally required.

The local illumination calculation unit can calculate brightness distribution of the pixels of the frames corresponding to the sections of the backlight unit. The local illumination calculation unit sequentially counts a number of pixels from pixels having a darkest level with respect to each section to calculate brightness of some pixels. The local illumination calculation unit requests a weighted average of the brightness calculated with respect to each section and brightness which is calculated with respect to other sections adjacent to each section, and calculates a time average of the weighted average.

The image incongruity can be prevented due to the weighted-average even if the pixels of the sub-frame are corrected by using light amount calculated based on the brightness of the frame image. In addition, the image incongruity can be prevented due to the time average even if the image has a great time variation.

In another aspect of the present invention, a display apparatus includes a backlight unit, a display unit, an image signal receiver, a frame interpolator, a local illumination calculation unit, and a pixel adjuster.

The backlight unit has a plurality of sections on which light sources are installed, and the display unit has a plurality of pixels which allow light generated from the light sources to pass therethrough. The image signal receiver receives an image signal of a plurality of consecutive frames to sequentially output the frames, and the frame interpolator generates sub-frames based on the frames sequentially output from the image signal receiver and sequentially outputs the frames and the sub-frames. The local illumination calculation unit calculates amount of the light, which is generated from the sections of the backlight unit, based on brightness of the frames sequentially output from the frame interpolator, and calculates the amount of the light, which is generated from the sections of the backlight unit, based on brightness of the sub-frames sequentially output from the frame interpolator. The pixel adjuster adjusts light transmittance of pixels of the display unit according to pixel brightness of the frames and the sub-frames, which are sequentially output from the frame interpolator, and the light amount calculated by the local illumination calculation unit. In this case, the pixel adjuster adjusts the transmittance based on brightness of sub-frames next to the frames output from the frame interpolator, and the light amount calculated by the local illumination calculation unit based on the brightness of the frames.

In this display apparatus, the light emission amount of each light source of the backlight unit is controlled by using the brightness of each pixel of a frame having a frame frequency increased due to the generation of the sub-frame. In addition, pixels are corrected based on the light amount of each light source. Accordingly, the local illumination calculation unit may have an operating speed higher than that of the display apparatus according to the previous embodiment described above. However, since the pixel adjuster adjusts transmittance of the pixels based on the pixel brightness of a sub-frame output next to a frame output from the frame interpolator and the light amount calculated by the local illumination calculation unit based on the brightness of the frame image, the memory may have the same storage capacity as that of the display apparatus according to the previous embodiment described above. In addition, the power consumption of the display apparatus can be reduced due to local illumination.

In still another aspect of the present invention, according to method of driving a display apparatus, the display apparatus includes a backlight unit having a plurality of sections on which light sources are installed, and a display unit having pixels which allow light generated from the light sources to pass therethrough. In the method of driving the display apparatus, frames used to display an image corresponding to an acquired image signal are sequentially output, and frames are sequentially output according to the image signals representing plural consecutive frames. Amount of the light, which is generated from the sections of the backlight unit, is calculated based on brightness of the frames which are sequentially output, and the light sources are controlled based on the light amount. Sub-frames are generated based on the frames, which are sequentially output, so that the frames and the sub-frames are sequentially output. Light transmittance of pixels of the display unit is adjusted according to the brightness of the frames and the sub-frames, which are sequentially output, and the light amount.

As described above, according to the display apparatus and the method of driving the same, a frame frequency can be increased, and local illumination can be realized without increasing the number of memory devices to display frames.

BRIEF DESCRIPTION OF THE DRAWINGS

The above and other advantages of the present invention will become readily apparent by reference to the following detailed description when considered in conjunction with the accompanying drawings wherein:

FIG. 6 is a view showing target light amount obtained in each section;

FIG. 7 is a view showing target light amount generated by a light source provided in each section;

FIG. 8 is a view showing target light amount generated from the light source provided in each section and temporally adjusted;

DESCRIPTION OF THE EMBODIMENTS

Hereinafter, preferred embodiments according to the present invention will be described in more detail with reference to the accompanying drawings.

Figure 1:
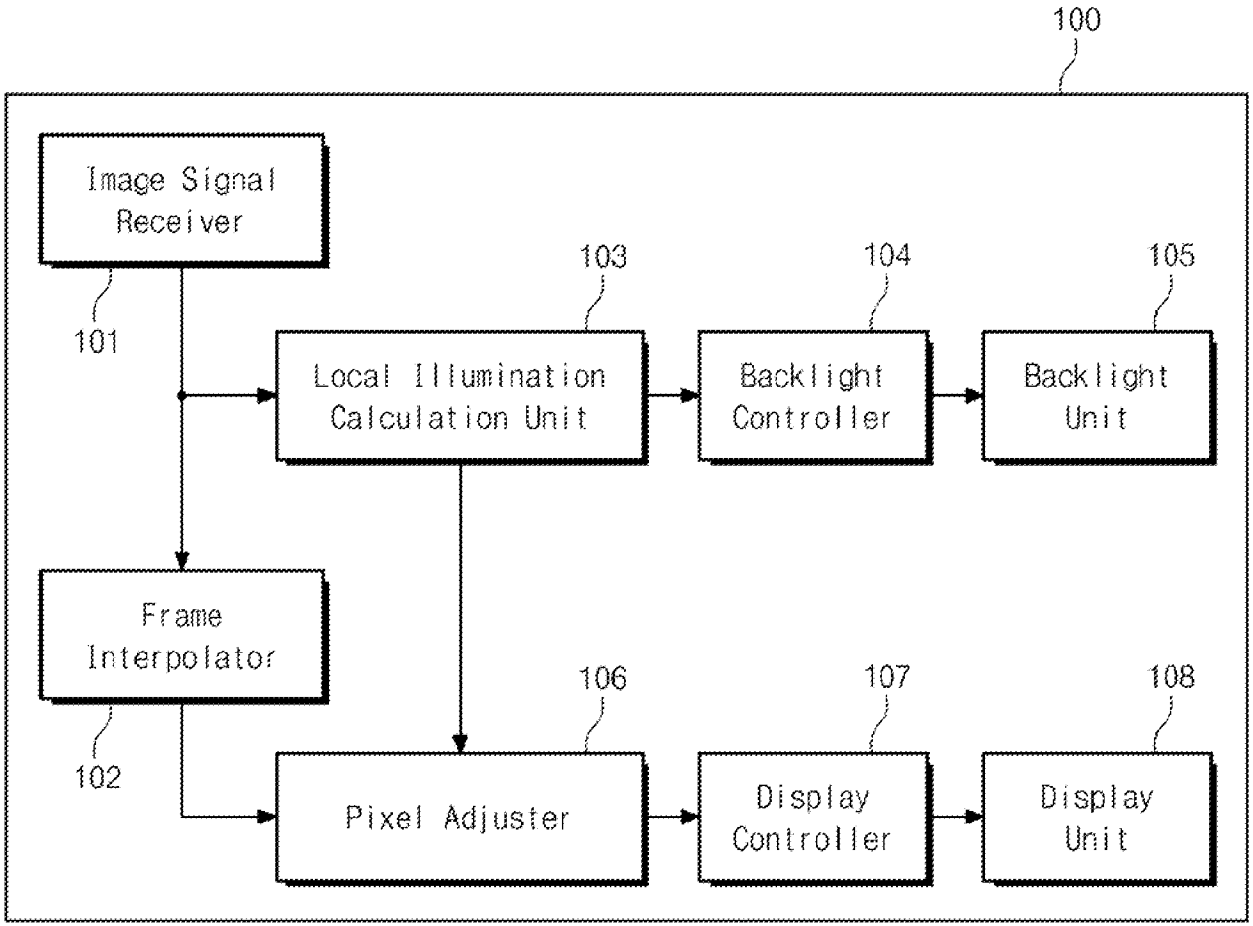
FIG. 1 is a block diagram showing a display apparatus according to an embodiment of the present invention.

FIG. 1 is a block diagram showing a display apparatus 100 according to an embodiment of the present invention.

Referring to FIG. 1, the display apparatus 100 includes an image signal receiver 101, a frame interpolator 102, a local illumination calculation unit 103, a backlight controller 104, a backlight unit 105, a pixel adjuster 106, a display controller 107, and a display unit 108.

The image signal receiver 101 receives an image signal. The image signal is received, e.g., by a tuner of a TV, reproduced from contents recorded on media by a reader, or generated through the execution of an application program or a player program by a computer (e.g., a personal computer), so that the image signal is received by the image signal receiver 101.

According to the present invention, an image can be displayed in a frame unit by the image signal. When the image is displayed according to the image signal, a progressive scheme may be used to express the whole portion of one frame through one scanning operation. In addition, an interlace scheme may be used to display the image by dividing the image into fields acquired by scanning odd-number scan lines and even-number scan lines, respectively.

The image signal received in the image signal receiver 101 is not required to have only signals consecutively representing information of plural frames. Between former and latter frames, the image signal may include a signal (e.g., a synchronization signal) representing information which is not directly related to the frames. In addition, the image signal receiver 101 is not required to consecutively output the frames. In other words, a predetermined time interval may exist between the former and latter frames.

According to one embodiment of the present invention, after the image signal received in the image signal receiver 101 is transformed, frames for image display are consecutively output from the image signal receiver 101. Then, according to the present embodiment, the frames output from the image signal receiver 101 are transmitted to both the frame interpolator 102 and the local illumination calculation unit 103.

The backlight unit 105 generates light for image display. According to the present embodiment, when a liquid crystal panel is used as the display unit 108, the backlight unit 105 directly or indirectly irradiates light from the lowest portion of the liquid crystal panel. In this case, the backlight unit 105 includes a light emitting surface to generate light transmitted to pixels of the liquid crystal panel. According to one embodiment of the present invention, the light emitting surface is divided into a plurality of sections, and a light source is provided in each section to control the light emission amount. For example, the backlight unit 105 may employ a light emitting diode (LED) as the light source to rapidly change light emission amount.

The backlight unit 105 is divided into several sections arranged in the form of a matrix in transverse and longitudinal directions. A plurality of LED groups are provided in each section. For example, the plural LED groups are provided to emit red (R), green (G), and blue (B) light. In order to remove a difference in light emission amount according to the positions of the sections, light from the LEDs may be diffused by a light diffusion plate and irradiated onto the display unit 108. Hereinafter, the sections of the backlight unit 105 are designated as row and column numbers. For example, a section, which is positioned in an $i^{th}$ row and a $j^{th}$ column, is expressed as "$S_{ij}$"

The display unit 108 includes a plurality of pixels. Each pixel of the display unit 108 can control transmittance of light generated from the backlight unit 105. The pixels display an image by controlling the light transmittance. The display unit 108 may include the liquid crystal panel on which liquid crystal pixels are arranged in the form of a matrix.

The frame interpolator 102 generates sub-frames for frame interpolation based on a series of frames consecutively output from the image signal receiver 101. The sub-frames are generated and added to the series of frames, thereby increasing a frame frequency of the image signal. In other words, time required to output each frame or each sub-frame can be reduced, and time required to display an image represented by each frame or each sub-frame can be reduced.

After a difference value between two consecutive frames is calculated, information of a predicted image based on the difference value can be generated as a sub-frame. In order to generate the sub-frame, the variation of each pixel of a frame is found based on a requested difference value, and the variation is applied into each pixel of a frame, thereby generating the sub-frame. The generation of the sub-frame is signified by the difference value being applied to the latter frame. If an image of the former frame is moved in the latter frame, a vector can be calculated by finding a motion vector that minimizes a difference value in brightness between the former frame and a moved frame by the motion vector. In addition, instead of finding the movement direction and movement distance (motion vector) of the whole frame, the frame is divided into blocks based on a motion picture experts group (MPEG), and a motion vector of each block may be found as a difference value. Then, the difference value is applied to pixels of the latter frame, thereby generating a sub-frame.

If the former and latter frames have a low correlation or have no correlation therebetween due to the change of a scene, the motion vector cannot be calculated. In this case, the frame interpolator 102 may output the last frame output from the image signal receiver 101 as the sub-frame.

In addition, the sub-frame can be obtained by finding the variation between pixels of the two consecutive frames in terms of an RGB value or a luminance/contrast/color value. That is, the variation is calculated as a difference value between pixels of the two consecutive frames, and the sub-frame is generated on the assumption that the difference value is maintained between two consecutive frames. For example, in a specific pixel, an R value of a latter frame is reduced by "Δ" with respect to an R value of a former frame, "−Δ" is calculated as a difference value, and a sub-frame is generated by adding "Δ/2" to an R value of the pixel of the latter frame, so that the sub-frame is interpolated between the latter frame and a next frame of the latter frame. The R value can be, for example, the RGB value or the luminance/contrast/color value of the pixel.

Figure 2:
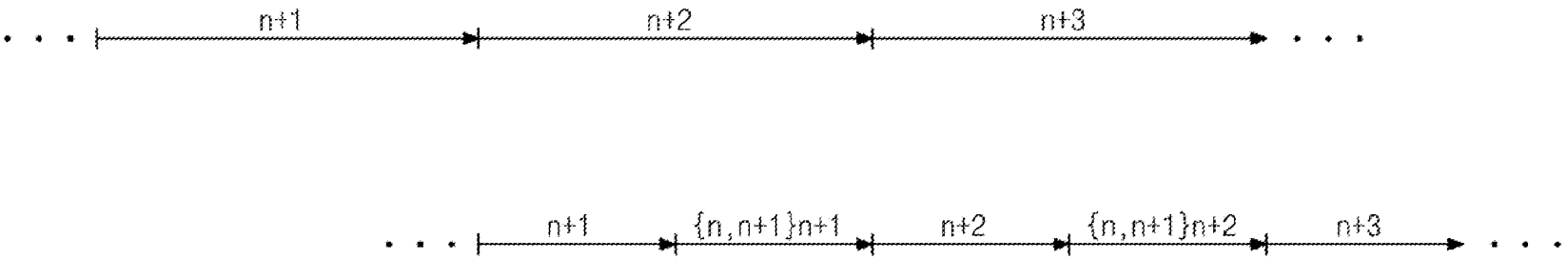
FIG. 2 is a time chart showing frames.

FIG. 2 is a timing chart showing sub-frames corresponding to frames formed by the image signals transmitted from the image signal receiver 101

As shown in FIG. 2, a series of frames is output from the image signal receiver 101 in order of an $(n+1)^{th}$ frame (n+1), an $(n+2)^{th}$ frame (n+2), an $(n+3)^{th}$ frame (n+3), etc. (as shown in the upper timeline). Hereinafter, a difference value between an $i^{th}$ frame and an $(i+1)^{th}$ frame that is a next frame of the $i^{th}$ frame is expressed as "{i, i+1}", and a sub-frame generated by applying the difference value to the $(i+1)^{th}$ frame is expressed as "{i, i+1}i+1".

As shown in FIG. 2, while the $(n+2)^{th}$ frame (n+2) is being received from the image signal receiver 101, the frame interpolator 102 outputs the $(n+1)^{th}$ frame (n+1) received prior to the $(n+2)^{th}$ frame (n+2). Simultaneously, the frame interpolator 102 calculates the difference value {n,n+1}. In addition, the frame interpolator 102 outputs a first sub-frame {n,n+

1}n+1 (as shown in the lower timeline) while receiving the $(n+2)^{th}$ frame (n+2). Thereafter, while the image signal corresponding to an $\{n+3\}^{th}$ frame (n+3) is being received from the image signal receiver 101, the frame interpolator 102 outputs the $(n+2)^{th}$ frame (n+2) and an $(n+2)^{th}$ sub-frame ({n,n+2}n+2). Accordingly, time corresponding to one frame is required until a predetermined frame of the image signal is output from the frame interpolator 102 after the frame has been output from the image signal receiver 101. For example, when 60 frames exist during one second, 1/60 second is required. As shown in FIG. 2, for the case when 60 frames exist during one second, the frame interpolator 102 outputs 120 frames during one second. In detail, as shown in FIG. 2, 1/60 second is required until the frame interpolator 102 starts to output the $(n+1)^{th}$ frame (n+1) of the image signal after the image signal receiver 101 has output the $(n+1)^{th}$ frame n+1 of the image signal, so that time delay may occur.

Figure 3:
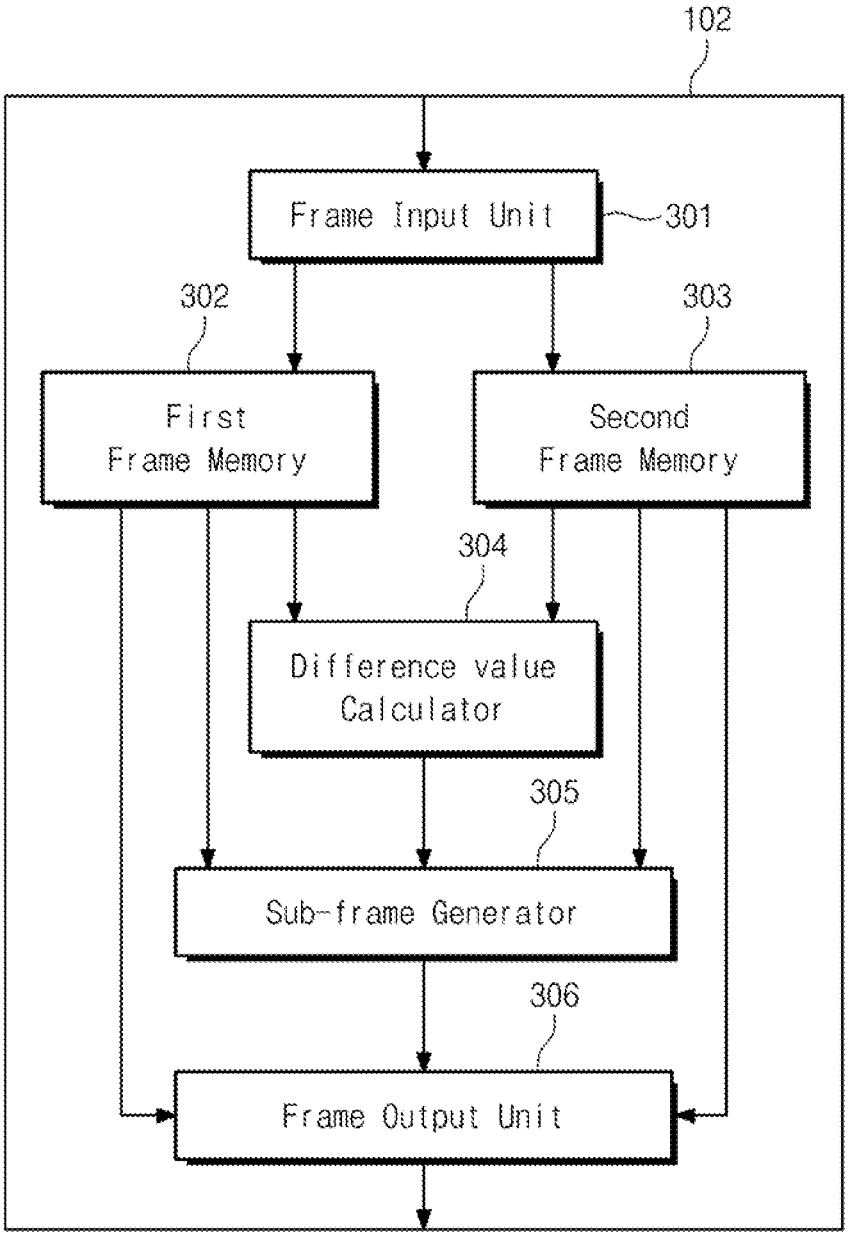
FIG. 3 is a block diagram showing the structure of a frame interpolator.

FIG. 3 is a block diagram showing the structure of the frame interpolator 102.

Referring to FIG. 3, the frame interpolator 102 includes a frame input unit 301, a first frame memory 302, a second frame memory 303, a difference value calculator 304, a sub-frame generator 305, and a frame output unit 306.

The frame input unit 301 selectively inputs frames of the image signal from the image signal receiver 101 into the first and second frame memories 302 and 303. In one example, the first frame memory 302 has storage capacity sufficient to memorize one frame. Similarly, in another example, the second frame memory 303 has storage capacity sufficient to memorize one frame. The difference value calculator 304 reads out former and latter frames of two frames input into the first and second frame memories 302 and 303 to calculate a difference value between the former and latter frames. The sub-frame generator 305 applies the difference value from the difference value calculator 304 to the latter frame of the frames input into the first and second frame memories 302 and 303 to generate a frame predicted as a sub-frame intermediate between the former and latter frames. The frame output unit 306 sequentially outputs the frames, which have been stored in the first and second frame memories 302 and 303, and the sub-frame, which has been generated from the sub-frame generator 305, as shown in the timing chart of FIG. 2.

Referring back to FIG. 1, the local illumination calculation unit 103 calculates the light emission amount of a light source provided in each section of the backlight unit 105 after sequentially receiving frames from the image signal receiver 101. Then, the local illumination calculation unit 103 provides the light emission amount to the display unit 108 to display an image based on the frame. The light emission amount is used when the display unit 108 displays an image corresponding to the frame transmitted from the image signal receiver 101. Generally, the brightness of light sources provided in the sections of the backlight unit 105 is set such that each pixel of the display unit 108 to display an image corresponding to each section has the maximum brightness. However, since the number of pixels having the maximum brightness is small, light having brightness lower than the maximum brightness may be generated.

According to the present embodiment, the local illumination calculation unit 103 acquires frames from the image signal receiver 101 and calculates a light amount required to display images corresponding to the frames. According to the present embodiment, the local illumination calculation unit 103 calculates light emission amount ($D_{ij}^{k}$) of a light source provided in a section ($S_{ij}$) necessary to display a $k^{th}$ frame (k). Meanwhile, even though light emission amount of the light source provided in the section ($S_{ij}$) is represented as "$D_{ij}^{k}$", the same light emission amount may not be obtained in all sections. For example, if light emission amount of a light source in a predetermined section is "0", light emission amount is gradually reduced in the direction of the predetermined section. Accordingly, the $D_{ij}^{k}$ may be calculated by taking into consideration the variation of light amount in each section. The variation of the light amount is determined based on light emission amount of a light source provided in another section. The $D_{ij}^{k}$ may have a vector quantity including several scalar quantities, instead of a single scalar quantity. In this case, each scalar quantity may represent light amount related to the position of each light source or the position of each pixel.

Figure 4:
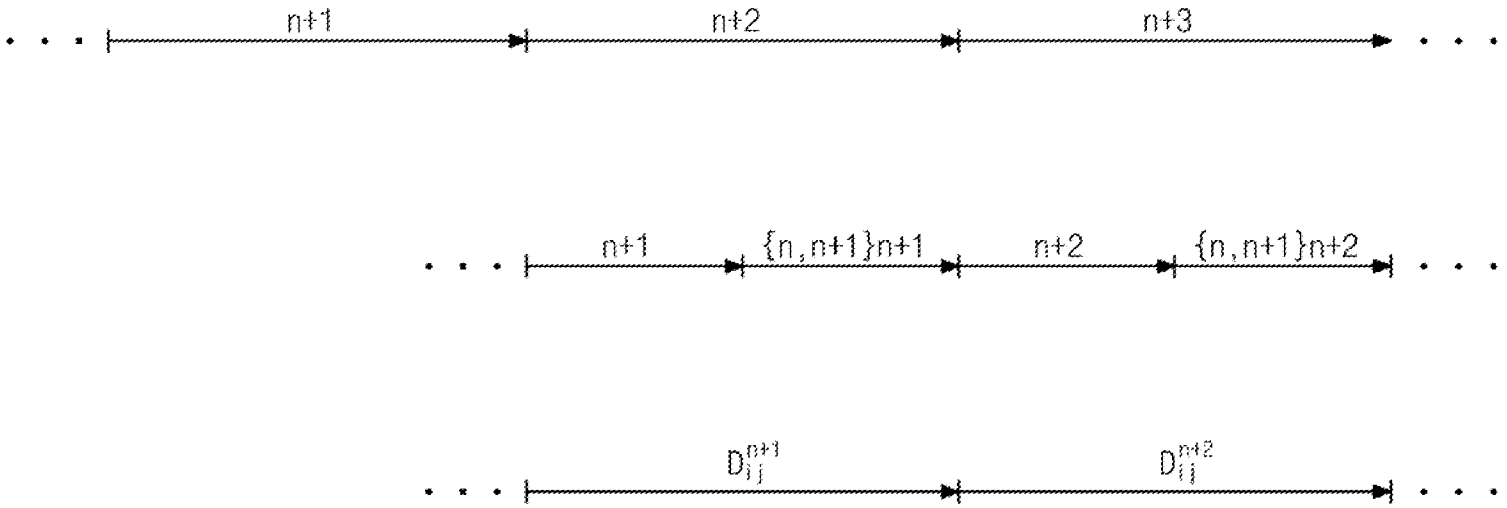
FIG. 4 is a time chart showing frames and light amount calculated by a local illumination calculation unit.

FIG. 4 is a timing chart showing frames output from the image signal receiver 101 (as shown in the top timeline), frames output from the frame interpolator 102 (as shown in the middle timeline), and light emission amount of a light source in a section that is positioned in an $i^{th}$ row and a $j^{th}$ column (hereinafter, referred to as " an $(i\times j)^{th}$ section) (as shown in the bottom timeline).

In other words, FIG. 4 is a view showing light amount calculated by the local illumination calculation unit 103 according to the change of time in addition to FIG. 2. As shown in FIG. 4, according to the present embodiment, when the display unit 108 controls light transmittance in response to the $(n+1)^{th}$ frame (n+1) and the $(n+1)^{th}$ sub-frame ({n, n+1}n+1) that have been output from the frame interpolator 102, light emission amount of a light source provided in the section of the backlight unit 105 becomes $D_{ij}^{n+1}$. When the display unit 108 controls light transmittance in response to the $(n+2)^{th}$ frame (n+2) and the $(n+2)^{th}$ sub-frame ({n, n+1}n+2) that have been output from the frame interpolator 102, light emission amount of a light source provided in the section of the backlight unit 105 becomes $D_{ij}^{n+}$.

Figure 5:
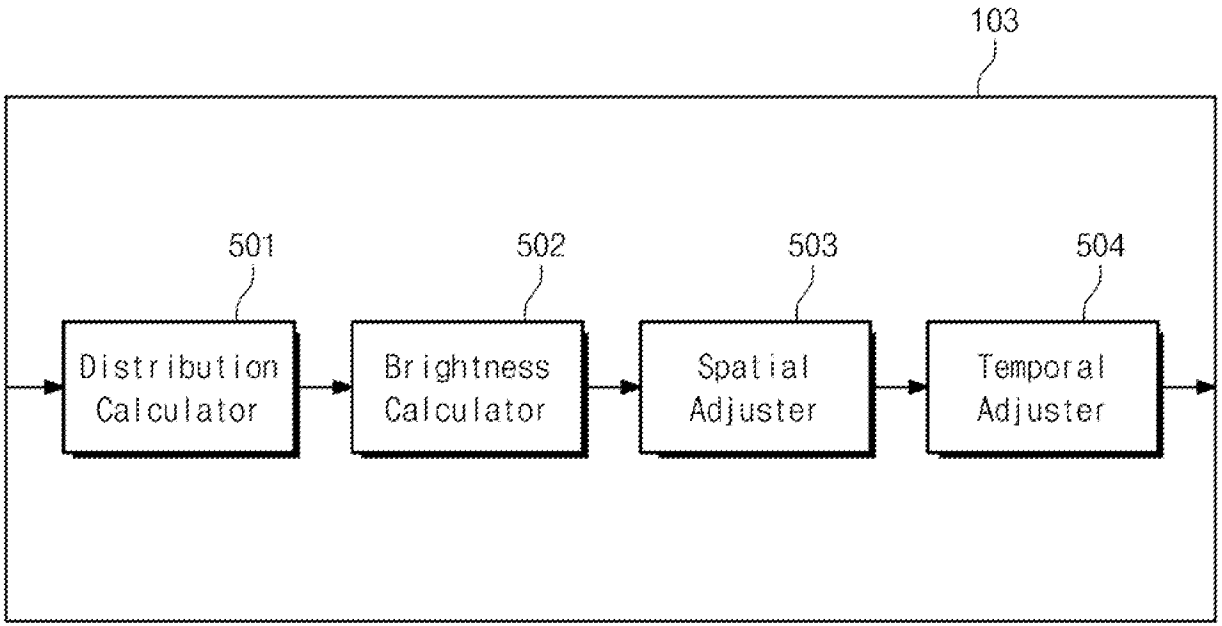
FIG. 5 is a block diagram showing the structure of the local illumination calculation unit.

FIG. 5 is a block diagram showing the structure of the local illumination calculation unit 103. Referring to FIG. 5, the local illumination calculation unit 103 includes a distribution calculator 501, a brightness calculator 502, a spatial adjuster 503, and a temporal adjuster 504.

In order to display the image on the display unit 108, the distribution calculator 501 calculates the number of pixels in each section of the backlight unit 105 while classifying the pixels according to brightness levels of the pixels. In other words, the distribution calculator 501 calculates the distribution of the brightness levels in each section after light generated from the section ($S_{ij}$) for the frame passes through pixels. Meanwhile, brightness levels after the light generated from the $S_{ii}$ has been transmitted to pixels are referred to as pixel brightness in the $S_{ij}$. The distribution of the pixel brightness in the $S_{ij}$ may be calculated by using the value of each primary color (red (R), green (G), or blue (B)). In addition, when a color specified by using an RGB value is converted into a color having a luminance/contrast/saturation value, the distribution of the pixel brightness may be calculated using luminance values.

The brightness calculator 502 calculates light amount of a light source provided in each section based on the distribution of the brightness levels obtained from the distribution calculator 501. For example, the brightness calculator 502 counts the number of pixels corresponding to a brightness level sequentially from the darkest brightness level of "0" and finds the brightness level when the number of the pixels corresponding to the brightness level exceeds a preset value. In contrast, the brightness calculator 502 may count the number of pixels corresponding to a brightness level sequentially from the maximum brightness level and find the brightness level when the number of pixels corresponding to the brightness level exceeds the preset value.

For example, the preset value may be defined as 95% of the total number of pixels. The preset value may not be an integer. The preset value may be varied according to standard deviation of the distribution of the brightness levels. For example, if the standard deviation is less, the preset value may be set to approximately 100% of the total number of pixels.

FIG. 6 is a view showing target light amount ($d_{ij}^n$) obtained in the section ($S_{ij}$) with respect to the $n^{th}$ frame (n). In addition, the brightness calculator 502 may calculate an average ($d_{ij}^n$) of the light amount calculated corresponding to each frame.

The spatial adjuster 503 averages the light amount calculated by the brightness calculator 502 based on light amount in neighboring sections. For example, as shown in FIG. 7, target light amount ($sD_{ij}^n$) that may be produced from a light source provided in each section is calculated through a weighted-average. In other words, values obtained by multiplying the $D_{ij}^n$ by a predetermined weight $a_{ij}^{k1}$ sum up with respect to k and i to calculate the $sD_{ij}^n$.

The temporal adjuster 504 finds a time average of the light amount averaged by the spatial adjuster 503. FIG. 8 is a view showing light amount that may be produced from a light source in each section and calculated based on both "$D_{ij}^{n-1}$" for a previous frame and "$sD_{ij}^n$" for a present frame. When β is defined as a number from 0 to 1, the $sD_{ij}^n$ and the $D_{ij}^{n-1}$ are internally divided in the ratio of β to 1-β to calculate the $D_{ij}^n$. The β may be an integer, or a value calculated through a predetermined process according to the variation in the brightness of a frame. In addition, the value calculated from the spatial adjuster 503 may be used with respect to the past three frames or more as well as the previous frame.

The backlight controller 104 outputs a control signal to control a light source provided in each section of the backlight unit 105 such that the light source can represent light emission amount calculated from the local illumination calculation unit 103. For example, the control signal may be used to adjust power supplied to the backlight unit 105, and control the light source such that the light source represents the light emission amount calculated from the local illumination calculation unit 103. For example, the control signal may be used to apply a voltage corresponding to the light emission amount to LEDs of each section. In addition, the control signal may be used to apply a signal having a duty ratio according to the light emission amount to the LEDs of each section.

When displaying an image for frames and sub-frames sequentially output from the frame interpolator 102, the pixel adjuster 106 adjusts transmittance of each pixel in response to light emission amount of a light source in each section which is calculated by the local illumination calculation unit 103. In detail, the pixel adjuster 106 adjusts a brightness level of each pixel representing an image corresponding to the frames and the sub-frames output from the frame interpolator 102 in response to the light emission amount of the light source calculated by the local illumination calculation unit 103. For example, when a brightness level of a specific pixel representing an image of the $n^{th}$ frame (n) is defined as "$P^n$", the pixel may display an image by light of a light source producing the $D_{ij}^n$. In addition, when the brightness in the pixel is defined as $L_{ij}^n$, transmittance is changed such that a brightness level of the pixel becomes "$P^n*MAX/L_{ij}^n$". The term "MAX" means the maximum brightness level (e.g., MAX=255). If the "$P^n*MAX/L_{ij}^n$" exceeds the maximum brightness level, the "$P^n*MAX/L_{ij}^n$" is set to a value of the MAX.

The display controller 107 outputs a control signal to the display unit 108 such that transmittance of each pixel of the display unit 108 is adjusted to the transmittance regulated by the pixel adjuster 106. In other words, the display controller 107 applies the control signal to the display unit 108 such that the display unit 108 displays an image with a brightness level of each pixel regulated by the pixel adjuster 106.

Meanwhile, according to the present embodiment, an image corresponding to frames can be displayed on the display unit 108 according to timing shown in FIG. 4. In addition, the display unit 108 further includes a controller which controls the backlight unit 105 to generate light. The local illumination calculation unit 103 may adjust timing to output the $D_{ij}^n$, so that timing shown in FIG. 4 can be realized.

According to the present embodiment, the display unit 108 increases a frame frequency, and delays an image signal received in the image signal receiver 101 by one frame in order to realize local illumination as shown in FIG. 1. When a sub-frame is generated by using two frames, the frame interpolator 102 may include a storage space capable of storing two frames.

Further, since the local illumination calculation unit 103 can be operated using a frame frequency which is not increased, the increase of the operating frequency is unnecessary and the increase of power consumption can be prevented.

In addition, an image signal that has been received in the image signal receiver 101 may be output only to the frame interpolator 102 in a frame unit. In this case, the local illumination calculation unit 103 may calculate brightness distribution of each section by directly reading out a frame stored in the first frame memory 302 or the second frame memory 303 without calculating the brightness distribution of each section by memorizing the frame output from the image signal receiver 101.

If the difference value {n, n+1} between frames is calculated as a motion vector, and the frame image is still represented corresponding to a specific section after a portion of a frame image, which has been displayed corresponding to the specific section, has been moved, image incongruity does not occur even if the $(n+1)^{th}$ sub-frame ({n, n+1}n+1) is displayed using the light amount $D_{ij}^{n+1}$. In addition, if the frame image is mainly displayed corresponding to neighboring sections after the portion of the frame image has been moved, and if k differs from 1, the spatial adjuster 503 increases $\alpha_{ij}^{k1}$ such that the image incongruity may not occur even if the $(n+1)^{th}$ sub-frame ({n, n+1}n+1) is displayed using the light amount $D_{ij}^{n+1}$.

In addition, the operating frequency of the local illumination calculation unit 103 is increased, and the difference value {n, n+1} is obtained from the frame interpolator 102, so that light emission amount of a light source of the $S_{ij}$ required to display the $(n+1)^{th}$ sub-frame ({n, n+1}n+1) can be calculated by using the difference value {n, n+1} and the $D_{ij}^{n+1}$ until the $(n+1)^{th}$ sub-frame ({n, n+1}n+1) is displayed. For example, the light emission amount of the light source in the $S_{ij}$ is defined as light emission amount of a light source provided in a section obtained after the section $S_{ij}$ has been moved according to the motion vector.

Figure 9:
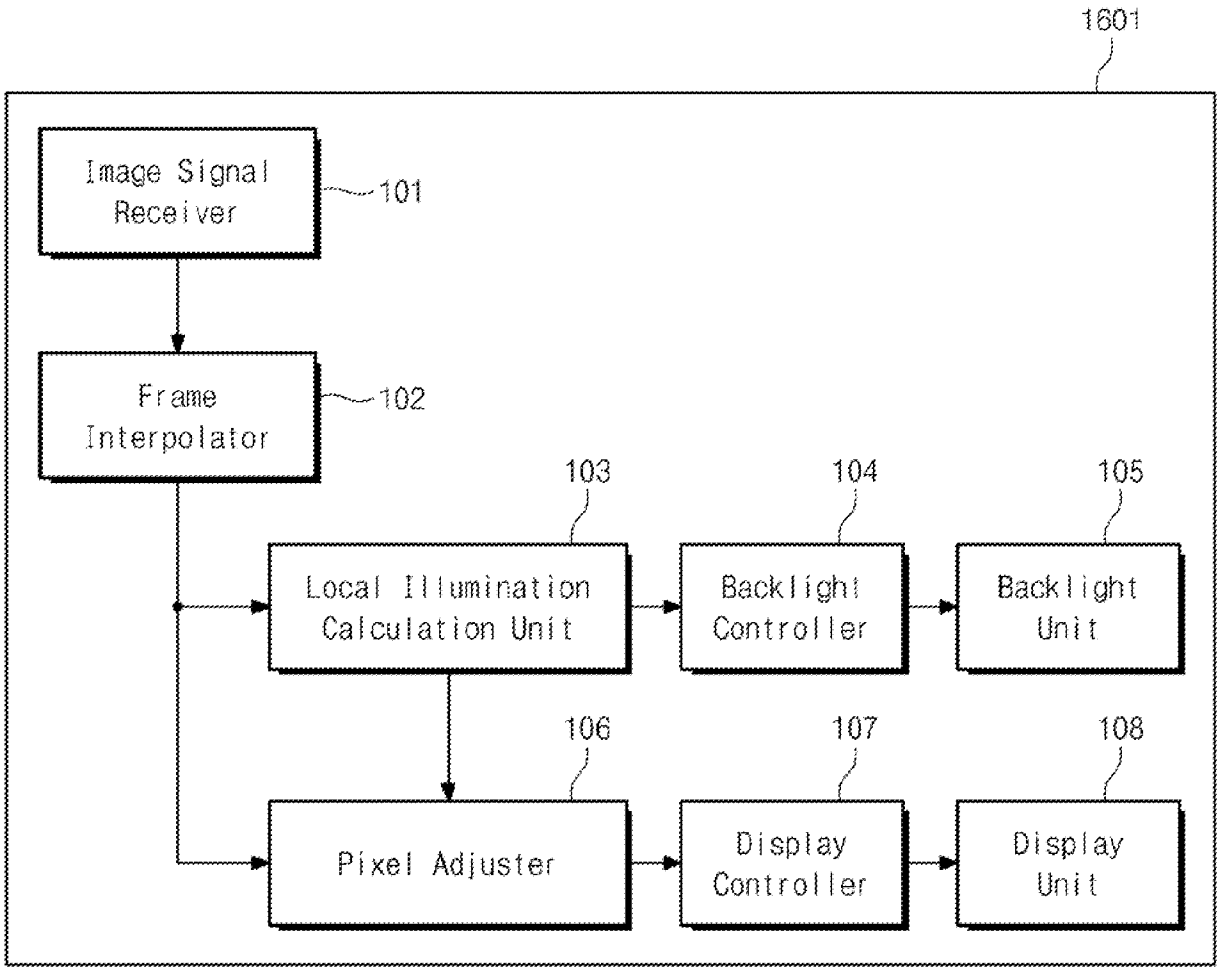
FIG. 9 is a block diagram showing a display apparatus according to another embodiment of the present invention.

FIG. 9 is a block diagram illustrating a display apparatus 1601 according to another embodiment of the present invention.

Referring to FIG. 9, the display apparatus 1601 includes the image signal receiver 101, the frame interpolator 102, the local illumination calculation unit 103, the backlight controller 104, the backlight unit 105, the pixel adjuster 106, the display controller 107, and the display unit 108.

According to the present embodiment, after an image signal received in the image signal receiver 101 is subject to a predetermined conversion process, the image signal is transferred to the frame interpolator 102. The frame interpolator 102 generates a sub-frame to increase the frame frequency of the image signal, and outputs the image signal to the pixel adjuster 106 and the local illumination calculation unit 103. The local illumination calculation unit 103 calculates light emission amount, which is produced from each section of the backlight unit 105, based on frames of the image signal having the increased frame frequency, so that an operating speed of the local illumination calculation unit 103 is N times as fast as the operating speed in the previous embodiment of the present invention. For example, if the frame frequency is increased by two times, the operating speed of the local illumination calculation unit 103 is twice as fast as the operating speed in the previous embodiment of the present invention.

Figure 10:
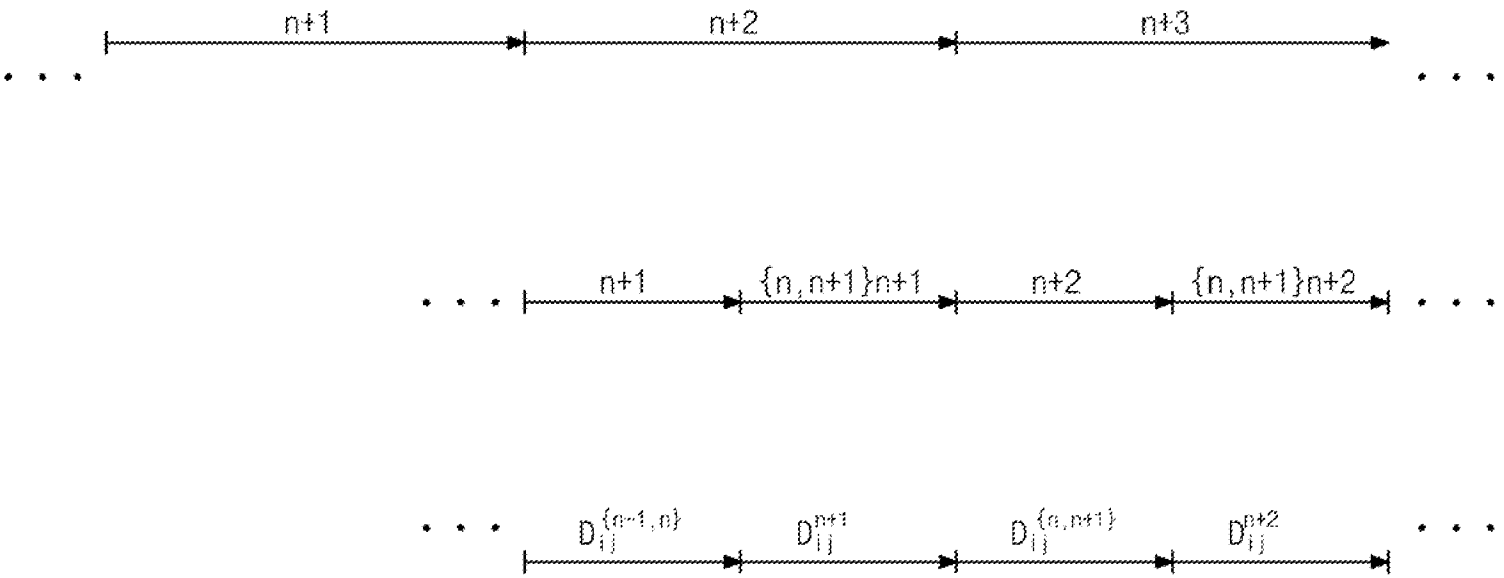
FIG. 10 is a timing chart showing light amount calculated by a local illumination calculation unit

FIG. 10 is a timing chart showing the light amount calculated by the local illumination calculation unit 103 in addition to FIG. 2.

As shown in FIG. 10, while an $(n+1)^{th}$ frame (n+1) output from the frame interpolator 102 is being displayed on the display unit 108, the backlight unit 105 generates light amount ($D_{ij}^{\{n-1,n\}}$). The $D_{ij}^{\{n-1,n\}}$ is calculated based on an $n^{th}$ sub-frame ({n−1, n}n). Further, while an $(n+1)^{th}$ sub-frame ({n,n+1}n+1) output from the frame interpolator 102 is being displayed on the display unit 108, the backlight unit 105 generates light amount ($D_{ij}^{n+1}$). That is, the $D_{ij}^{n+1}$ and $D_{ij}^{n+2}$ are calculated based on the sub-frames subsequent to an $(n+1)^{th}$ frame (n+1) and an $(n+2)^{th}$ frame (n+2), respectively. This process is equal to the process performed in the previous embodiment. However, regarding another frame and another sub-frame, a display operation is performed using light amount calculated based on a frame and a sub-frame prior to another frame and another sub-frame. Accordingly, the present embodiment includes the local illumination calculation unit 103 or the backlight controller 104 to increase the light amount generated from the backlight unit 105, as in the case of the previous embodiment.

According to the display apparatus of the present embodiment, the image signal received in the image signal receiver 101 is delayed by one frame as shown in FIG. 10, so that the frame frequency can be increased and the local illumination can be achieved. Further, in the case of generating a sub-frame using two frames, a storage space can be provided in the frame interpolator 102 to store two frames.

Further, the local illumination calculation unit 103 can calculate brightness distribution with respect to each section by directly reading frames stored in a first frame memory 502 and a second frame memory 503, instead of calculating the brightness distribution of each section by using the frames and the sub-frames output from the frame interpolator 102. In such a case, only a storage area corresponding to the total two frames is required.

Although embodiments of the present invention have been described, it is understood that the present invention should not be limited to these embodiments but various changes and modifications can be made by one ordinary skilled in the art within the spirit and scope of the present invention as hereinafter claimed.

What is claimed is:

1. A display apparatus, comprising:

a backlight unit having a plurality of sections each generating a light;

a display unit having a plurality of pixels allowing the light to pass therethrough;

an image signal receiver receiving an image signal having a plurality of consecutive frames to sequentially output the frames;

a frame interpolator generating at least one (n+1)-th sub-frame (n is an integer larger than 1) by applying, to an (n+1)-th frame, a difference value between an n-th frame and the (n+1)-th frame, and sequentially outputting the (n+1)-th frame and the (n+1)-th sub-frame, wherein the n-th frame corresponds to a former frame and the (n+1)-th frame corresponds to a latter frame;

a local illumination calculation unit calculating a target light amount generated from the sections based on a brightness of the (n+1)-th frame; and a backlight controller controlling the backlight unit to generate the target amount of the light from the sections while the (n+1)-th frame and the (n+1)-th sub-frame are being displayed.

2. The display apparatus of claim 1, further comprising a pixel adjuster adjusting a light transmittance of the pixels of each of the (n+1)-th frame and the (n+1)-th sub-frame according to a pixel brightness of each of the(n+1)-th frame and the (n+1)-th sub-frame and the target light amount calculated based on the (n+1)-th frame.

3. The display apparatus of claim 1, wherein the frame interpolator is configured to minimize the difference value and apply the minimized difference value to the (n+1)-th frame, so as to generate the (n+1)-th sub-frame.

4. The display apparatus of claim 1, wherein the difference value is calculated based on a difference between RGB values or a difference between at least one of luminance, contrast, and color values.

* * * * *